US006463765B2

(12) United States Patent
Blakely

(10) Patent No.: US 6,463,765 B2
(45) Date of Patent: Oct. 15, 2002

(54) PANTYHOSE UNDER GARMENT

(76) Inventor: Sara T. Blakely, 800-A E. Morningside Dr., Atlanta, GA (US) 30324

( * ) Notice: Subject to any disclaimer, the term of this patent is extended or adjusted under 35 U.S.C. 154(b) by 0 days.

(21) Appl. No.: 09/894,729

(22) Filed: Jun. 28, 2001

(65) Prior Publication Data

US 2001/0035032 A1 Nov. 1, 2001

Related U.S. Application Data

(63) Continuation of application No. 09/544,829, filed on Apr. 6, 2000, now Pat. No. 6,276,176.

(51) Int. Cl.[7] ..... D04B 9/46
(52) U.S. Cl. ..... 66/178 R
(58) Field of Search ..... 66/171, 178 R, 66/182, 183, 184, 185, 178 A, 116 R; 450/101, 156, 104; 2/239, 240

(56) References Cited

U.S. PATENT DOCUMENTS 3,440,665 A * 4/1969 Russell ..... 2/240
3,625,029 A * 12/1971 Safrit et al. ..... 2/240
4,351,068 A 9/1982 Taylor ..... 2/409
4,862,523 A 9/1989 Lipov ..... 2/409
5,097,537 A 3/1992 Ewing ..... 2/409
5,465,894 A * 11/1995 Clark et al. ..... 227/175.1
6,151,927 A * 11/2000 Owens et al. ..... 66/178 R

* cited by examiner

*Primary Examiner*—Danny Worrell
(74) *Attorney, Agent, or Firm*—Alston & Bird LLP

(57) ABSTRACT

A pantyhose garment is provided that has relatively sheer leg portions that end with knitted-in welts just below or above the knees, and a reinforced control top portion having good shaping and control characteristics that terminates at the top of the waist region with a knitted-in welt. The pantyhose under garment provides the user with shaping support, and because the lower leg is bare, it gives the user the freedom to wear any type of shoe (i.e., open-toed shoes, sandals, etc.). Pantyhose worn with open-toed shoes are usually undesirable, and also dangerous because the foot may slip in the shoe due to the lack of friction between the pantyhose and the shoe. In addition, there are many occasions when the user wants a more casual look in clothing, and therefore pantyhose on the foot and ankle would not be desired. The reinforced control top portion extends down the leg portions of the pantyhose far enough to provide support over the "saddlebag" and cellulite regions of the body. The knitted-in welt at the waist region blends into the control top without causing waist constriction. Similarly, the knitted-in welts at the ends of the leg portions blend into the leg portions without causing leg constriction. The overall design provides the user with a smooth, tight appearance when worn under clothing, without causing the user to suffer discomfort.

14 Claims, 2 Drawing Sheets

PANTYHOSE UNDER GARMENT

CROSS-REFERENCE TO RELATED APPLICATION

The present application is a continuation of U.S. patent application Ser. No. 09/544,829 filed Apr. 6, 2000, now issued as U.S. Pat. No. 6,276,176.

TECHNICAL FIELD OF THE INVENTION

The present invention relates to a pantyhose under garment and, more particularly, to a pantyhose under garment having sheer leg portions that end with knitted-in welts just below or above the knees and a control top portion having good shaping and control characteristics that terminates in the waist region with a knitted-in welt.

BACKGROUND OF THE INVENTION

A strong need exists for women to have an alternative under garment to traditional underwear and girdles. Traditional underwear creates undesirable panty lines under clothing, especially when worn with slim fitting skirts and slacks. Also, in addition to panty lines, traditional underwear can become easily misplaced, causing discomfort to the wearer. This also creates bulges under clothing. One alternative to traditional underwear is underwear known as a "g-string". This type of underwear is comprised of one piece of fabric that goes up the buttocks of the user so that panty lines do not occur. However, this under garment offers no support and is extremely uncomfortable to some users and may not be an option at all for users with vulvar conditions such as vulvar vestibulitis.

These types of under garments do not provide the user with an improved appearance under clothing and can be uncomfortable. Furthermore, they do not hold in bulges and cellulite on the most troubled areas of some users. These areas, known as "saddlebags", are below the buttocks on the back and sides of the thighs just below the hips. Although girdles cover these areas, they normally are made of relatively thick material and tend to stop above the knee, which creates bulges in clothing about the user's thigh. Also, the thick fabric usually makes the user look heavier rather than thinner in slim fitting clothing.

Although pantyhose can now be manufactured in such a way that panty lines are often prevented, they are not an option in many cases because the leg portions of pantyhose usually cover the feet. Therefore, the pantyhose would be visible when worn under certain types of clothing, which normally is undesirable. For example, pants that stop below the knees, typically referred to as "capri pants", would not be worn with normal pantyhose because the pantyhose would be visible. Also, pantyhose are not desired while wearing most stylish shoes (i.e., open-toed shoes, sandals, etc.).

Although pantyhose designs are known which do not cover the feet, those designs do not solve all of the aforementioned problems. U.S. Pat. No. 4,351,068 discloses a footless pantyhose design. One of the objectives of this design is to provide air ventilation to the foot to prevent "athlete's foot" from occurring. However, the upper reinforced portion of the pantyhose, often referred to as the control top, does not extend down over the region where the need for support is often the greatest, i.e., the "saddlebag" region. Also, the waist and leg portions have elastic bands at their points of termination. Elastic bands are tight on the skin and, in many cases, leave indentations in the skin and may cut off circulation causing extreme discomfort for the user. Furthermore, elastic bands are not produced during the knitting process, i.e.; they are not knitted in during the knitting of the hose. Rather, they are sewn on after the hose have been knitted. In addition, the leg portions of this design extend to the ankle and, therefore, would be visible when worn under capri pants or with open-toed shoes. Also, when women cross their legs, most pants rise up on the leg and, therefore, the pantyhose may be visible even when worn with normal length pants, which is also normally undesirable.

U.S. Pat. No. 4,862,523 discloses a pantyhose garment having leg portions that terminate at the ankle. One of the objectives of this design is to help prevent sagging of soft body tissues. The garment has elastic bands running throughout it. As stated above, elastic bands bulge and create lines that can be seen under clothing and can produce discomfort. U.S. Pat. No. 5,097,537 discloses a multisectional hosiery garment that has detachable feet and leg sections. This design is intended to prevent the entire pantyhose from being ruined if a "run" occurs in a portion of the garment. The design is also intended to accommodate several different fashion purposes. The different sections are attached with elastic bands, which have the aforementioned disadvantages. A garment having this design would not provide the user with a slimmer or smoother appearance.

Accordingly, a need exists for a comfortable pantyhose garment that does not cover the lower legs or feet and that provides support in the thigh, buttocks and waist regions to help minimize or eliminate the appearance of "saddlebags". A need also exists for such a pantyhose garment is manufactured in a continuous knitting process so that the supportive regions blend in with the more sheer regions without creating seams or bands that can easily be seen through clothing.

SUMMARY OF INVENTION

The present invention provides a pantyhose under garment having relatively sheer leg portions that end with knitted-in welts just below or above the knees, and a reinforced control top portion having good shaping and control characteristics that terminates at the top of the waist region with a knitted-in welt. The pantyhose under garment provides the user with shaping support and because the lower leg is bare it gives the user the freedom to wear any type of shoe (i.e., open-toed shoes, sandals, etc.). Pantyhose worn with open shoes are usually undesirable, and also dangerous because the foot slips in the shoe. In addition, there are many occasions when the user wants a more casual look in clothing, and therefore pantyhose on the foot and ankle would not be desired. The reinforced control top portion extends down the leg portions of the pantyhose far enough to provide support over the "saddlebag" and cellulite regions of the body. The knitted-in welt at the waist region blends into the control top without causing waist constriction. Similarly, the knitted-in welts at the ends of the leg portions blend into the leg portions without causing leg constriction. The overall design provides the user with a smooth, tight appearance when worn under clothing, without causing the user to suffer discomfort.

These and other features and advantages of the present invention will become apparent from the following description, drawings and claims.

DETAILED DESCRIPTION OF THE INVENTION

Figure 1:
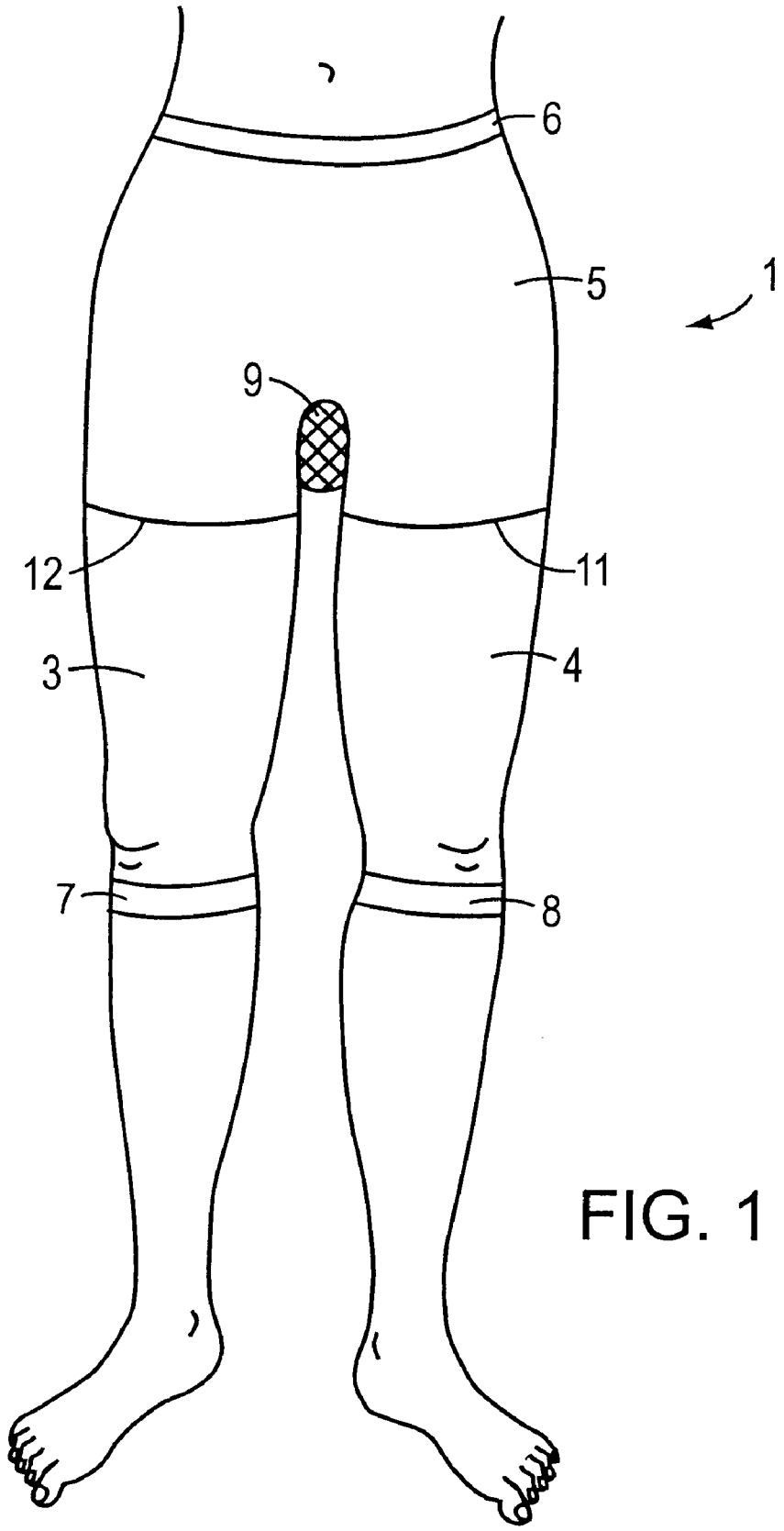
FIG. 1 illustrates the pantyhose under garment of the present invention in accordance with the one embodiment wherein the leg portions of the pantyhose undergarment terminate just below the knees.
Figure 2:
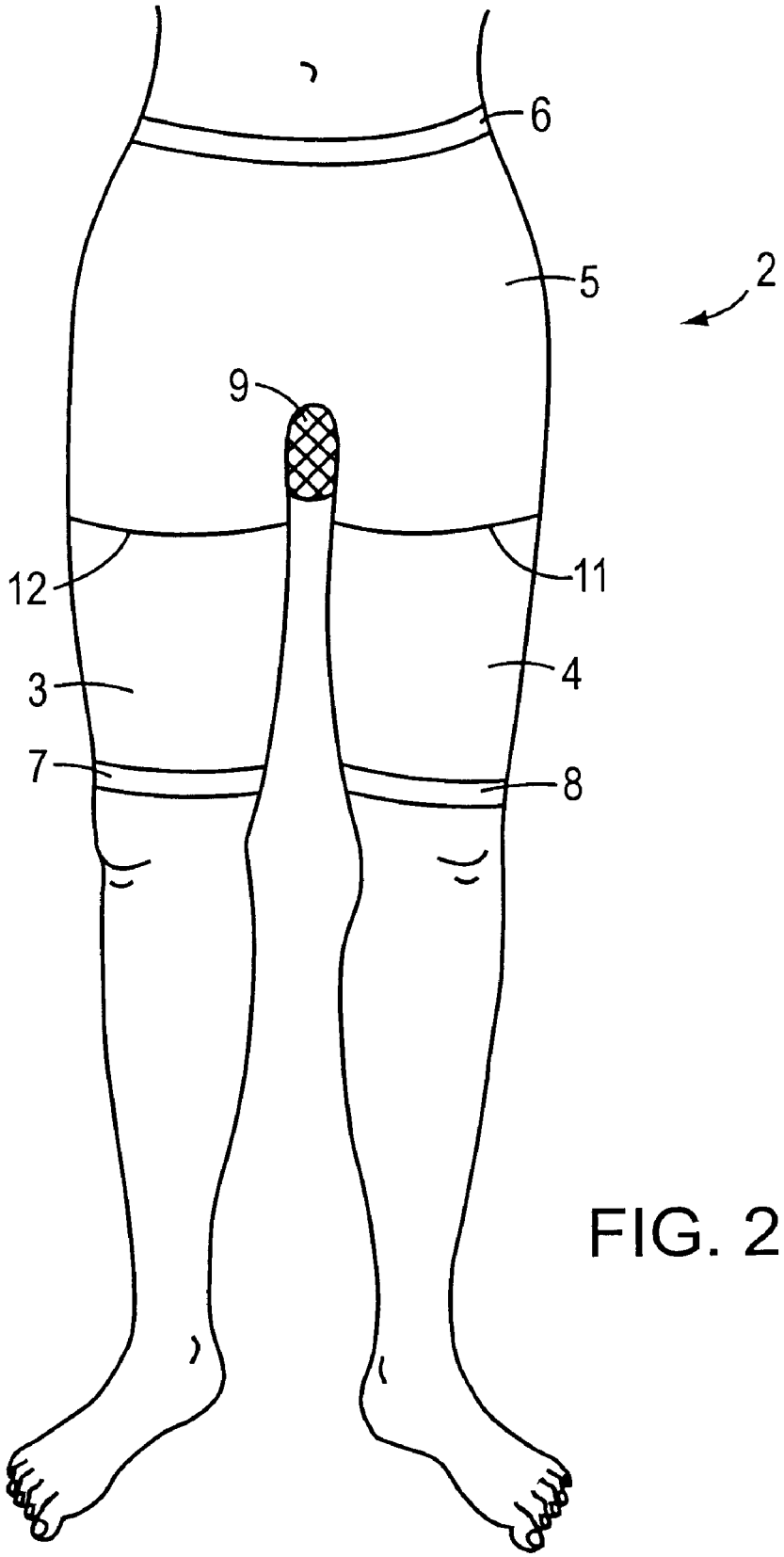
FIG. 2 illustrates the pantyhose under garment of the present invention in accordance with another embodiment wherein the leg portions of the pantyhose undergarment terminate on the thighs above the knees.

The under garment of the present invention in accordance with one embodiment wherein the leg portions terminate just below the knees is shown in FIG. 1. The under garment of the present invention in accordance with another embodiment wherein the leg portions terminate above the knee is shown in FIG. 2. With reference to each figure, the same numerals will be used to describe like elements. The under garment 1 may be manufactured in a conventional manner with conventional knitted fabric materials, such as, for example, nylon, lycra, spandex, silk, cotton, etc. In accordance with the preferred embodiment, the under garments 1 and 2 are manufactured on a circular hosiery knitting machine using a circular hosiery knitting process. As stated above, rather than using elastic bands, knitted-in welts are knitted in during the knitting process at the waist-terminating region and at the leg terminating regions. This enables the garment to be manufactured in one, continuous knitting process, as opposed to performing an additional manufacturing process after the knitting process has been performed in order to attach elastic bands, as in the aforementioned prior art. Circular knitting machines and processes are well known. Those skilled in the art will understand the manner in which the garments 1 and 2 of the present invention can be manufactured using such a machine and process.

The under garment of the present invention in accordance with one embodiment wherein the leg portions terminate just below the knees is shown in FIG. 1. The under garment of the present invention in accordance with another embodiment wherein the leg portions terminate above the knee is shown in FIG. 2. With reference to each figure, the same numerals will be used to describe like elements. The under garment 1 may be manufactured in a conventional manner with conventional knitted fabric materials, such as, for example, nylon, LYCRA®, spandex, silk, cotton, etc. In accordance with the preferred embodiment, the under garments 1 and 2 are manufactured on a circular hosiery knitting machine using a circular hosiery knitting process. As stated above, rather than using elastic bands, knitted-in welts are knitted in during the knitting process at the waist-terminating region and at the leg terminating regions. This enables the garment to be manufactured in one, continuous knitting process, as opposed to performing an additional manufacturing process after the knitting process has been performed in order to attach elastic bands, as in the aforementioned prior art. Circular knitting machines and processes are well known. Those skilled in the art will understand the manner in which the garments 1 and 2 of the present invention can be manufactured using such a machine and process.

The control top portion 5 also preferably extends down the leg portions 3 and 4, preferably approximately 8 to 13 inches below where the leg portions 3 and 4 begin. The lines 11 and 12 indicate the locations where the control top portion 5 ends and the leg portions 3 and 4 begin. Preferably, the control top portion 5 is manufactured using a plane-knit process. In accordance with one embodiment, each of the four feeds contains a single yarn. Preferably, the first coarse is LYCRA® yarn, which is a product of E. I. Du Pont de Nemours and Company, or spandex yarn, which is a more generic term for the same or substantially similar material manufactured by many different manufacturers. Preferably, the spandex or LYCRA® has a denier of 120, but may range from approximately 60 to approximately 150 in denier.

The second coarse is a nylon yarn, preferably a 7034 textured nylon having a denier ranging from approximately 40 to approximately 100. The third coarse preferably is identical to the first course. The fourth coarse preferably is identical to the second coarse. Alternatively, the plane-knit process used for the control top could utilize a 7034 textured nylon and a 120-denier spandex or LYCRA® yarn. Before transferring from the control top to the knitting of the sheer leg portions 3 and 4, a 3×1 T-bar is knitted in so that the crotch, which preferably is cotton, can later be sewn on.

The leg portions 3 and 4 preferably are very sheer in order to maximize comfort for the user. When manufacturing the leg portions 3 and 4, the knitting process transfers to a plane-knit process after the knitted-welts 7 and 8 terminating the leg portions 3 and 4 have been completed. The plane-knit process corresponds to what is commonly referred to as the all-knit process, which means that all four feeds are up. Preferably, a 20/10/7 LYCRA® or spandex yarn is used in the first and third feeds. This corresponds to a 20-denier LYCRA® or spandex yarn covered with a 10 denier textured nylon yarn with 7 filaments. The second and fourth feeds preferably contain 15/7 textured yarns. The leg portions 3 and 4 preferably are comprised of a material ranging from an approximately 7 to approximately 40 denier nylon yarn and an approximately 10/7 to an approximately 40/13 LYCRA® yarn.

The knitted-in welts 6, 7 and 8 comprise the thickest areas of the garment 1. The control top portion 5 is thicker than the leg portions 3 and 4 to provide additional support, and as stated above, extends over the "saddlebag regions". The knitted-in welt 6 comprising the waistband preferably is manufactured as follows. All of the feeds preferably use the same yarns, which is a 360-denier yarn manufactured by Globe Manufacturers. A 1×1 yarn selection is contained on the first feed. A 1×1 selection means that 1 of the needles is up whereas the other is down. The second feed preferably utilizes a plane-knit selection, which means that all needles are up. The third feed preferably utilizes a 1×1 alternate, which means that whatever needle was facing up on feed 1, the corresponding needle on feed 3 is facing down. Feeds 2 and 4 utilize a plane-knit selection, which means all needles are up. Preferably, a single rubber yarn is knitted into the knitted-in welt 6 to ensure that the waistband and is secured about the waist of the user. However, the rubber yarn is optional because the denier used in this region is believed to be sufficient to provide the needed support. Also, the single rubber yarn should not be confused with the aforementioned elastic bands that were used as the waistbands in prior art designs. The present invention utilizes the knitted-in welts to produce the waist and leg bands so that the discomfort and other disadvantages associated with elastic bands are avoided. It should also be noted that where a 1×1 selection has been specified above, a 3×1 selection could be used instead.

The knitted-in welts 7 and 8 comprising the leg bands are manufactured identically to the manner in which the knitted-in welt 6 comprising the waistband is manufactured, except that the single optional rubber yarn used in the knitted-in welt 6 comprising the waistband is not needed in the knitted-in welts 7 and 8 comprising the leg bands. However, a rubber yarn may be used in the knitted-in welts 7 and 8 comprising the leg bands if desired. FIG. 2 illustrates another embodiment of the present invention wherein the knitted-in welts 7 and 8 comprising the leg bands are above the knee. This garment 2 preferably is identical to the garment 1 shown in FIG. 1 in all other respects. Therefore, a detailed discussion of the garment 2 shown in FIG. 2 will not be provided herein in the interest of brevity.

Those skilled in the art will understand that the present invention is not limited with respect to the denier or yarns used for the different portions of the garments 1 and 2. The selections, yarns and deniers specified above are simply the preferred embodiments. Those skilled in the art will understand that many modifications may be made to the present invention and that all such modifications are within the spirit and scope of the present invention.

What is claimed is:

1. An undergarment comprising:

a waistband having a knitted-in welt;

a control top portion knitted to the waistband, the control top portion including a panty portion having panty legs that extend partway down the thighs of a person wearing the undergarment; and leg portions knitted to the panty legs of the control top portion, wherein each leg portion terminates at a lower end thereof with a knitted-in welt for snugly fitting about the leg of a person wearing the undergarment, and the leg portions are knit to be of a substantially thinner fabric than the control top.

2. The undergarment of claim 1, wherein said undergarment comprises yarn and wherein the welts have a yarn of a denier greater than the yarn of the leg portions.

3. The undergarment of claim 2, wherein said undergarment comprises yarn and wherein the welts have a yarn of a denier greater than the yarn of the control top portion.

4. The undergarment of claim 1, wherein said undergarment comprises yarn and wherein the welts have a yarn of a denier greater than the yarn of the control top portion.

5. The undergarment of claim 1, wherein said leg portions incorporate spandex yarn.

6. The undergarment of claim 5, wherein said leg portions further include a second yarn that is textured.

7. An undergarment comprising:

a waistband having a knitted-in welt;

a control top portion knitted to the waistband; and leg portions knitted to the control top portion, wherein each leg portion terminates at a lower end thereof with a knitted-in welt for snugly fitting about the leg of a person wearing the undergarment, and the leg portions are knit to be of a substantially thinner fabric than the control top portion.

8. The undergarment of claim 7, wherein each leg portion is knit as a seamless fabric tube on a circular knitting machine.

9. The undergarment of claim 7, wherein the leg portions are knit to be substantially sheer and the control top is knit to be substantially non-sheer.

10. A method for making an undergarment, comprising:

knitting a waistband as a knitted-in welt;

knitting a control top to the waistband, the control top being knit to smooth bulges of a person wearing the undergarment;

knitting leg portions to the control top such that the leg portions have a length sized to terminate the leg portions above the feet of a person wearing the undergarment, the leg portions being knit to be a substantially thinner fabric than the control top; and knitting welts to lower ends of the leg portions such that the welts form leg bands that snugly fit about the legs of a person wearing the undergarment.

11. The method of claim 10, wherein the leg bands, leg portions, panty portion, and waistband are knit in that order.

12. The method of claim 10, wherein the control top is knit as a panty portion having panty legs that extend partway down the thighs of a person wearing the undergarment.

13. The method of claim 12, wherein each leg portion is knit as a seamless fabric tube on a circular knitting machine and the panty leg corresponding to said leg portion is integrally knit as a continuation of said fabric tube but with a different knit construction from the leg portion.

14. The method of claim 10, wherein the leg portions are knit to be substantially sheer and the control top is knit to be substantially non-sheer.

* * * * *

UNITED STATES PATENT AND TRADEMARK OFFICE

CERTIFICATE OF CORRECTION

PATENT NO. : 6,463,765 B2
DATED : October 15, 2002
INVENTOR(S) : Blakely

It is certified that error appears in the above-identified patent and that said Letters Patent is hereby corrected as shown below:

Title page,
Item [56], References Cited, U.S. PATENT DOCUMENTS, insert
-- 5,590,548 1/1997 Osborne
5,746,068 5/1998 Popa et al. --.

Insert -- FOREIGN PATENT DOCUMENTS,
DE 3304 901 A1 8/1984
EP 0387 210 A2 9/1990
EP 1039 001 A2 9/2000 --.

Column 3,
Cancel lines 11-35,
After line 60, insert lines 15-28,

--The pantyhose garment 1 comprises two leg portions 3 and 4 and a control top portion 5. The control top portion 5 of the garment 1 preferably is terminated at the waist with a knitted-in welt 6. The welt 6 preferably ranges from 1 to 3 inches in width. The leg portions 3 and 4 preferably are terminated with knitted-in welts 7 and 8 just below the knees. Preferably, the welts 7 and 8 range from 1 to 3 inches in width. However, those skilled in the art will understand that the widths of the leg and waistbands are not limited to any particular widths. The welts 6, 7 and 8 provide a snug fit on the user's legs and waist without overly constricting these areas. The crotch 9 is made of cotton. The crotch 9 preferably is sewn onto the garment 1 after the knitting process has been performed. The control top portion 5 is thicker than the leg portions 3 and 4 to provide additional support for the buttocks and upper thigh regions. The differences in thickness between the waist band, leg bands, control top and leg portions are indicated by the darker and lighter shaded areas, i.e., the darker the shading, the thicker the garment portion, the lighter the shading the sheerer the garment portion.--.

UNITED STATES PATENT AND TRADEMARK OFFICE

CERTIFICATE OF CORRECTION

PATENT NO. : 6,463,765 B2
DATED : October 15, 2002
INVENTOR(S) : Blakely

It is certified that error appears in the above-identified patent and that said Letters Patent is hereby corrected as shown below:

Column 4,
After Line 19, insert Lines 14-25,

--In accordance with the preferred embodiment of the present invention, the order in which the garment is manufactured is as follows: the knitted-in welts 7 and 8 that terminate the leg portions 3 and 4 are knitted first, the leg portions 3 and 4 are knitted next, the control top 5 is knitted after the leg portions 3 and 4, and the knitted-in welt 6 comprising the waistband is knitted last. This enables the knitting process to end with the knitting of the waistband, which is preferable to the knitting process ending with the knitting of the knitted-in welts comprising the leg bands. This is because, wherever the knitting process ends, a porting of the knitted material will remain. Through experimentation, it has been determined that for reasons of comfort and aesthetic appearances, this order provides the best results. However, those skilled in the art will understand that the garment 1 of the present invention is not limited with respect to the order in which the various portions of the garment 1 are knitted.--.

Signed and Sealed this

Thirteenth Day of May, 2003

JAMES E. ROGAN
*Director of the United States Patent and Trademark Office*